United States Patent [19]

Lozen

[11] Patent Number: 4,628,811

[45] Date of Patent: Dec. 16, 1986

[54] CUP PRINTER INCLUDING AN ENDLESS BELT INK CARTRIDGE

[76] Inventor: Franklin R. Lozen, 22600 Sherwood, Warren, Mich. 48091

[21] Appl. No.: 705,221

[22] Filed: Feb. 25, 1985

[51] Int. Cl.[4] ..... B41F 17/28

[52] U.S. Cl. ..... 101/38 R; 101/335; 101/336; 101/DIG. 7

[58] Field of Search ..... 101/38 A, 38 R, 39, 101/40, 36, DIG. 7, 202, 235, 335, 336, 350, 37

[56] References Cited

U.S. PATENT DOCUMENTS

| | | | |
|---|---|---|---|
| 47,516 | 5/1865 | Byrne et al. | 101/335 X |
| 71,978 | 12/1867 | Carter | 101/36 |
| 539,276 | 5/1895 | Lewin | 101/36 |
| 602,061 | 4/1898 | Echelberger | 101/202 X |
| 615,031 | 11/1898 | Malmborg | 101/350 X |
| 690,696 | 1/1902 | Cheshire | 101/336 X |
| 2,019,537 | 11/1935 | Kieckhefer | 101/39 |
| 2,299,242 | 10/1942 | Lui | 101/202 X |
| 3,092,019 | 6/1963 | Van Buskirk | 101/235 X |
| 3,599,566 | 8/1971 | Fish | 101/333 |
| 3,774,538 | 11/1973 | Bullock | 101/336 |

FOREIGN PATENT DOCUMENTS

| | | | |
|---|---|---|---|
| 1284841 | 8/1972 | United Kingdom | 101/38 R |

*Primary Examiner*—Clifford D. Crowder
*Attorney, Agent, or Firm*—Harold W. Milton, Jr.

[57] ABSTRACT

The cup printing assembly (10) including ink transfer rollers (20,22,24) for forming an ink image from an ink reservoir (14) and transferring the ink image to a cup (16). An ink reservoir (14) stores the ink to be transferred. The assembly (10) is characterized by the ink reservoir (14) being an absorbent continuous belt member (18) for retaining ink thereon.

13 Claims, 5 Drawing Figures

CUP PRINTER INCLUDING AN ENDLESS BELT INK CARTRIDGE

TECHNICAL FIELD

The subject invention relates to a printer assembly for printing messages and/or designs on disposable plastic drinking cups. Specifically, the instant invention relates to a means for storing the ink to be transferred.

BACKGROUND ART

The prior art is replete with various machines for transferring inked images onto a single cup or a plurality of cups automatically. Generally, the machines include means for storing the ink, means for transferring the ink to a dye, and means for transferring the image from the dye to a cup supported on a roller. An example of such an assembly is disclosed in the U.S. Pat. No. 3,209,688 to Eldred et al. The Eldred et al patent utilizes a squeegee method of transferring ink from a blotter type assembly onto a conical cup which is moved past and in engagement with the blotter assembly. The Eldred et al patent discloses a method of automatically applying an image of multiple colors onto a cup.

The U.S. Pat. No. 3,695,176 to Van Der Roer discloses a machine for printing on cups including an array of inking rollers. The rollers are selectively moved into contact with segments of a printing cylinder to coat them with suitably colored ink.

The U.S. Pat. No. 3,977,318 to Cohan discloses a machine for simultaneous two-image printing on a cup including inking means for applying a volatile color ink to a pair of rolls. The inking means includes two inking cylinders driven in synchronization with a turret and impression rolls.

The U.S. Pat. No. 2,019,537 to Kieckhefer discloses a method of printing containers and a machine therefor, the machine including a slotted receptacle for storing ink. Ink is being transferred from the slotted receptacle to the surface of a roller. Each of the prior art methods disclose either a flat pad or roller having ink thereon.

The prior art squeegee type methods have several disadvantages. First, the ink is often distributed unevenly by the squeegee type method. A single area of the squeegee may be worn during continuous use thereby causing an uneven distribution of ink thereon. Secondly, it is difficult to replace prior art ink reservoirs. The instant invention provides ink reservoir means which distributes ink evenly and is easily replaced.

STATEMENT OF THE INVENTION

According to the present invention there is provided a cup printing assembly including ink transfer means for forming an ink image from an ink reservoir and transferring the ink image to a cup. Ink reservoir means stores the ink to be transferred. The assembly is characterized by the ink reservoir means being an absorbent continuous belt member for retaining ink thereon.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
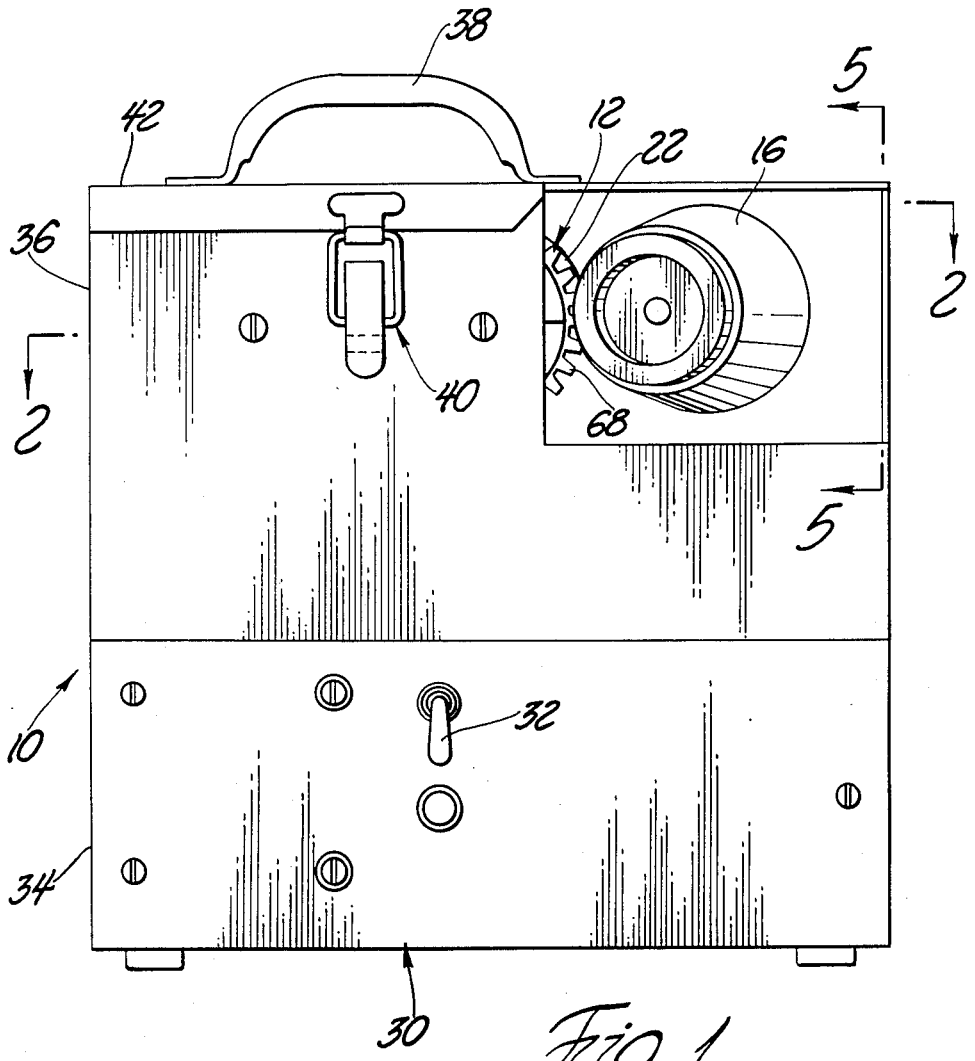
FIG. 1 is side view partially broken away of the instant invention.

A cup printing assembly constructed in accordance with instant invention is generally shown at 10 in the Figures. The assembly 10 includes ink transfer means generally indicated at 12 for forming an ink image from an ink reservoir generally indicated at 14 and transferring the ink image to a cup 16. The ink reservoir means 14 stores the ink to be transferred. The assembly 10 is characterized by the ink reservoir means 14 being an absorbent continuous belt member 18 for retaining ink thereon. The belt member retains an even distribution of ink thereover for providing an even supply of ink to the ink transfer means 12. The belt is made of an absorbent material so as to be initially saturated with ink. Contact of a roller with the belt member 18 transfers ink to the roller.

More specifically, the ink transfer means 12 includes a plurality of rollers 20,22,24 for transferring ink from the belt member 18 to the cup 16. The reservoir means 14 further includes belt support means for rotatably supporting the belt member 18 for transferring ink to at least one of the rollers 20. The belt support means includes a pair of spaced barrel ink support rollers 26,28. The belt member 16 is entrained over the pair of ink belt support rollers 26,28.

The assembly 10 includes drive means generally indicated at 30 for rotating the rollers 20,22,24 and belt member 18 together. The drive means may be an electric motor 30 which is turned on and off with a power switch 32. The motor 30 is contained within a motor housing 34 and the reservoir means 14 and ink transfer means 12 are contained in an upper housing 36 as shown in FIG. 1. The upper housing 36 may include a handle 38 and latch means generally indicated at 40 whereby access may be obtained by opening of a pivotally connected lid member 42. Access may also be gained through the side walls of the housing 36.

The belt member 18 includes a predetermined circumference so as to be tautly entrained about the rollers 26,28. Accordingly, rotation of the rollers 26, 28 moves the belt member 18 about the rollers 26, 28. The belt member 18 includes two band portions 44,46 extending about the circumference of belt member 18 and a separator groove 48 extending about the circumference and between the bands 44,46 for preventing different colored inks on each of the bands 44,46 from mixing. Unlike prior art blotter ink reservoirs which require a separate blotter to store different color inks, the instant invention provides a single belt member 18 including two bands 44,46, each band 44,46 being capable of storing a different color. The colors are prevented from mixing by the bands 44,46 being separated by the separator groove 48. The separator groove 48 may be made of a nonabsorbent material. This material can absorb no ink from either band 44,46.

The belt support means 14 is a removably mounted cartridge. The cartridge includes a base 50 supporting the ink belt support rollers 26,28. The base 50 may be removed from the assembly to allow easy access to the ink belt support rollers 26,28 which are removable from the base 50. In this manner, re-inking or replacement of the ink belt 18 is greatly facilitated.

The drive means 30 is operatively connected to a driven one of the ink belt support rollers 28 by a chain 52. The chain is entrained about an ink belt roller gear 54 having a clutch engagement with the shaft 56 upon which is mounted the driven ink belt member support roller 28. The assembly 10 includes control means in the form of the switch 32 operatively connected to the clutch gears 58 for actuating the drive means for printing on a single cup 16 as described below.

The ink transfer means 12 includes three rollers; a die support roller 20, a cup support roller 24, and an image transfer roller 22 disposed therebetween and in frictional contact with the die support roller 20 and cup support roller 24 for transferring an inked image from the die support roller 20 to the cup 16 mounted on the cup support roller 24. As the three rollers 20,22,24 are in frictional contact, driven rotation of one roller causes rotation of the other three.

Figure 2:
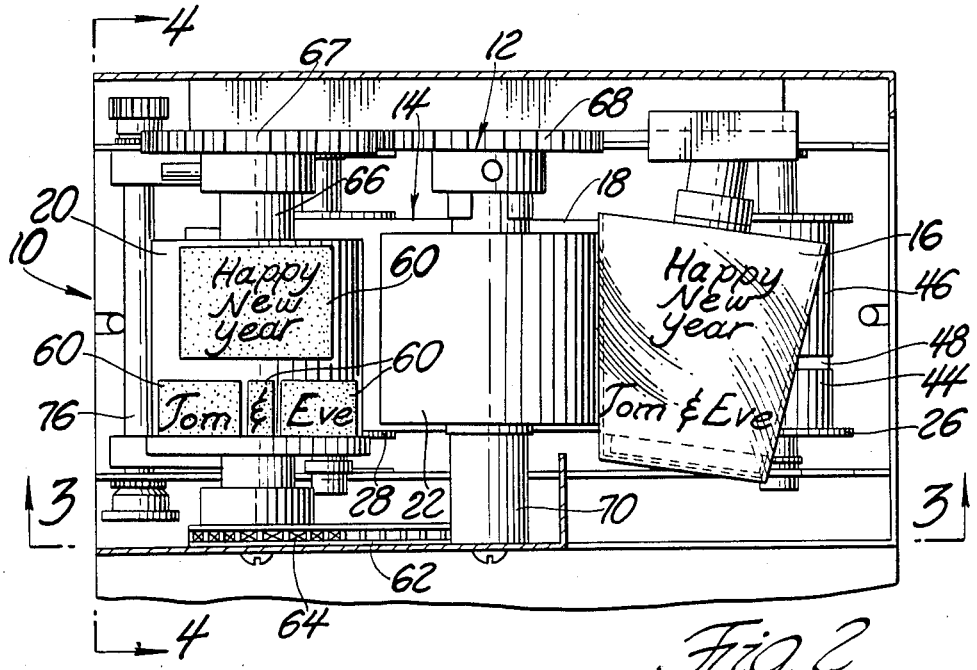
FIG. 2 is a fragmentary cross sectional view taken substantially along lines 2—2 of FIG. 1.
Figure 3:
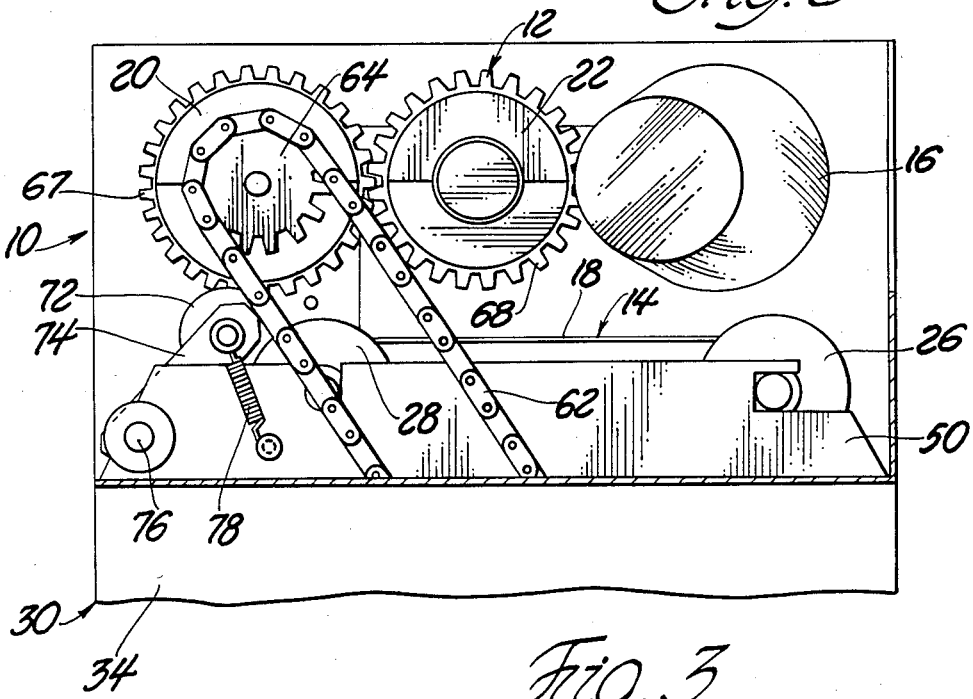
FIG. 3 is a fragmentary side view partially broken away taken substantially along line 3—3 of FIG. 2.
Figure 4:
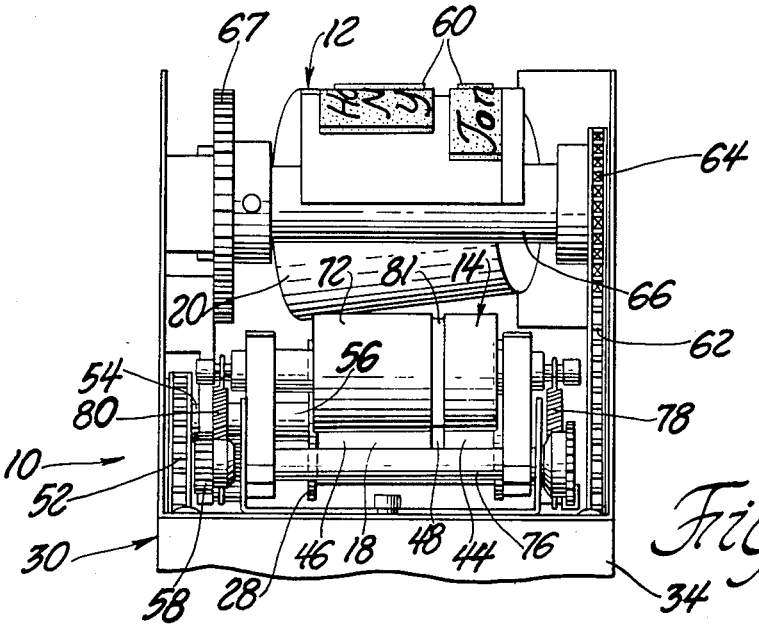
FIG. 4 is a fragmentary end elevational view partially broken away taken substantially along lines 4—4 of FIG. 2.
Figure 5:
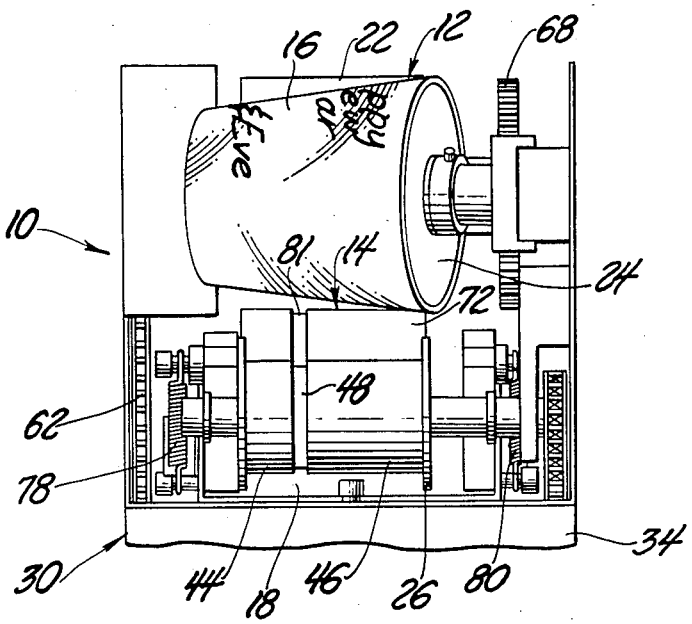
FIG. 5 is a fragmentary elevated end view partially broken away taken substantially along lines 5—5 of FIG. 1.

As shown in FIGS. 2 and 4, the die support roller 20 includes means for mounting a plurality of dies 60 thereon. The image transfer roller 22 includes means for mounting a cushion ink transfer material thereon which transfers the ink image from the dies 60 mounted on the die support roller 20 to the cup 16 mounted on the cup support roller 24. The image transfer roller 22 thereby provides a cushion upon which the dies 60 print a reverse image which is then transferred to the cup member as positive image, as shown in FIG. 2.

The drive means 30 is operatively connected to the die support roller 20 by a chain 62. The chain 62 is interconnected between a toothed gear (not shown) mounted on the motor comprising the drive means 30 and is entrained about a toothed gear 64. The toothed gear 64 is mounted on a shaft 66 upon which is mounted the die support roller 20. A second gear 66 having a toothed periphery is also fixedly mounted on the shaft 66. Another gear 67 includes a toothed periphery mounted on the shaft 66 and is in interlocking meshed engagement with the toothed periphery of a third gear 68. The gear 68 is mounted on a shaft 70 upon which is mounted the image transfer roller 22. In this manner, driven rotation of the die support roller 20 actuates rotation of the image transfer roller 22 and the cup support roller 24. The meshed connection between the gears 67 and 68 is critical because the image transfer roller 22 is only in frictional contact with the dies 60 and not with the remainder of the die support roller 20. The gears 66,68 insure simultaneous rotation of the two rollers 20,22.

The reservoir means 14 includes an ink transfer roller 72 for transferring ink from the belt member 18 to the dies 60 mounted on the die support roller 20. The reservoir means 14 further includes ink transfer roller support means comprising bracket member 74 pivotally mounted at 76 on the base 50. The bracket member 74 mounts the ink transfer roller 72 in frictional contact with belt member 18 and disposes the roller 72 adjacent the die support roller 20 to be in frictional contact with the dies 60 mounted on the die support roller 20. The reservoir means 14 includes a pair of springs 78,80 for biasing the ink transfer roller bracket 74 towards the belt member 18 whereby the ink transfer roller 72 is urged into frictional contact with the belt member 18.

The ink transfer roller 72 may include a separator groove 81 for preventing mixing of the different color inks transferred from the bands 44,46 of the belt member 18 to the ink transfer roller 72.

In operation, ink is fed to the ink transfer roller 72 from the belt member 18. Two colors of ink may be used at once on a single ink belt 18 as each band 44,46 may store a different color ink. Printing is effected through the series of rollers 20,22,24. In use, an operator mounts the cup on the conical cup support roller 24 and presses the print button 32 to print the desired image onto the cup 16. The cup 16 rotates through one print cycle and stops. The clutch gears 58 are operatively connected to the switch 32 whereby actuation of the switch 32 engages the clutch gears 58 to actuate rotation of the cup support roller 24 through one print cycle. Alternatively, the assembly 10 may operate continuously, being monitored by on/off actuation of the switch 32. The cup 16 is then removed with the message printed on it, leaving the cup support roller 24 for acceptance of the next cup.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A cup printing assembly (10) comprising: ink transfer means (12) for forming an ink image from an ink reservoir (14) and transferring the ink image to a cup (16); and said assembly (10) characterized by including an absorbent continuous belt member (18) for being the sole means for storing the ink to be transferred therein, said ink transfer means (12) including a plurality of rollers (20,22,24) for transferring ink from said belt member (18) to the cup (16), said reservoir means (14) further including belt support means rotatably supporting said belt member (18) for transferring ink to at least one of said rollers (20) and drive means (30) for rotating said rollers (20,22,24) and said belt member (18) together, said belt support means (14) being a cartridge removably mounted in said assembly (10) to provide access to said belt member (18).

2. An assembly as set forth in claim 1 further characterized by said belt member (18) including a predetermined circumference and at least two band portions (44,46) extending about said circumference and a separator groove (48) extending around said circumference and between said bands (44,46) for preventing different colored ink on each of said bands (44,46) from mixing.

3. An assembly as set forth in claim 1 further characterized by said belt support means including a pair of spaced barrel ink belt support rollers (26,28), said belt member (18) being entrained over said ink belt support rollers (26,28).

4. An assembly as set forth in claim 1 further characterized by said drive means (30) being operatively connected to at least one of said ink belt support rollers (28), said other ink belt support roller (26) being driven through said belt member (18).

5. An assembly as set forth in claim 1 further characterized by said ink transfer means (12) including a rotatable die support roller (20), a rotatable cup support roller (24) and an image transfer roller (22) disposed therebetween and in frictional contact with said cup support roller (24) for transferring an inked image from said die support roller (20) to a cup (16) mounted on said cup support roller (24).

6. An assembly as set forth in claim 5 further characterized by including a toothed die roller gear (67) operatively connected to said die support roller (20) and a toothed image transfer gear (68) operatively connected to said image transfer roller (22), said gears (67,68) being in meshing engagement.

7. An assembly as set forth in claim 6 further characterized by said drive means (30) being operatively connected to said die support roller (20) whereby driven rotation of said die support roller (20) actuates rotation of said image transfer roller (22) and said cup support roller (24).

8. An assembly as set forth in claim 5 further characterized by said image transfer roller (22) including mounting means for mounting a cushion ink transfer material thereon transferring the ink image from said die support roller (20) to a cup (16) mounted on said cup support roller (24).

9. An assembly as set forth in claim 1 further characterized by said reservoir means (14) including an ink transfer roller (72) for transferring ink from said belt member (18) to a die (60) mounted on said die support roller (20).

10. An assembly as set forth in claim 9 further characterized by said reservoir means (14) including ink transfer roller support means (74) for mounting said ink transfer roller (72) in frictional contact with said belt member (18) and disposed adjacent to said die support roller (20) to be in frictional contact with a die (60) mounted on said die support roller (20).

11. An assembly as set forth in claim 10 further characterized by said ink transfer roller support means (74) being pivotally connected to said reservoir means (14), said reservoir means (14) including biasing means (78,80) for biasing said ink transfer roller support means (74) towards said belt members (18) for urging said ink transfer roller (72) into frictional contact with said belt member (18).

12. An assembly as set forth in claim 10 further characterized by including control means for actuating said drive means (30) to drive said ink transfer means (12) and said ink reservoir means (14).

13. An assembly as set forth in claim 12 further characterized by said control means including clutch means (58) for actuating said drive means (30) to rotate said cup support roller (24) through a single revolution whereby the ink image is printed on a single cup (16) supported on said cup support roller (24).

* * * * *